United States Patent [19]

Arfert et al.

[11] Patent Number: 4,911,323

[45] Date of Patent: Mar. 27, 1990

[54] RESEALABLE CONTAINER CLOSURE

[75] Inventors: Horst F. Arfert, Chesterfield County; Roger H. Donaldson, Lancaster County; Eric L. Jensen; Wesley E. Smith, both of Chesterfield County, all of Va.

[73] Assignee: Reynolds Metals Company, Richmond, Va.

[21] Appl. No.: 317,416

[22] Filed: Mar. 1, 1989

[51] Int. Cl.[4] ..... B65D 51/22

[52] U.S. Cl. ..... 220/257; 220/258; 220/270; 220/278

[58] Field of Search ..... 220/257, 258, 270, 278

[56] References Cited

U.S. PATENT DOCUMENTS

| | | | |
|---|---|---|---|
| 2,153,263 | 4/1939 | Martter et al. | 220/48 |
| 2,367,300 | 1/1945 | McManus et al. | 220/48 |
| 3,850,330 | 11/1974 | Koontz et al. | 215/262 |
| 3,880,319 | 4/1975 | Wells et al. | 220/278 |
| 3,913,782 | 10/1975 | Cass | 220/260 |
| 3,931,905 | 1/1976 | Shumway et al. | 220/278 |
| 4,580,692 | 4/1986 | LaBarge et al. | 220/240 |
| 4,632,271 | 12/1986 | Taylor et al. | 220/258 |
| 4,709,830 | 12/1987 | Kreiseder | 220/258 |

*Primary Examiner*—Donald F. Norton

*Attorney, Agent, or Firm*—Alan T. McDonald

[57] ABSTRACT

An umbrella type resealable closure device is described. A metal container includes an end wall with a flanged region substantially surrounding a scored portion defining an openable panel. A resealable closure device incorporates a non-hooking closure structure on one side and a structure for separating the openable panel from the end wall on the opposite side.

70 Claims, 14 Drawing Sheets

RESEALABLE CONTAINER CLOSURE

FIELD OF THE INVENTION

The present invention relates to the field of resealable container caps. More particularly, this invention relates to an improved resealable cap including structure adapted to break open an openable panel in the top of the resealable container.

BACKGROUND OF THE INVENTION

Resealable closure devices of the "inverted umbrella" type for use on a metallic cans are known. U.S. Pat. Nos. 4,574,975 and 4,632,271 each describe a resealable closure device similar to that used in the present invention. The disclosures of U.S. Pat. Nos. 4,574,975 and 4,632,271 are incorporated by reference and relied upon in this disclosure.

The known closure devices comprise two components: a metallic end and a flexible closure element. The metallic end may be sealed to a can body using conventional sealing techniques, such as double sealing, or by such means as adhesive bonding. The metallic end has an opening which is surrounded by an outwardly directed and upstanding beaded, hemmed or curled flange. The flexible closure element forms a resealable closing device. This closure element includes a central panel which closes the opening in the metallic end and a lever and nose which are activated to seal the closure element onto the end. The nose does not hook under the edge of the hemmed flange, but is tightly held against the flange by tension within the closure element, as well as by the internal pressure within the canned body, when so filled.

Methods of detecting tampering with the contents of the container are also known in the field of resealable containers. For example, U.S. Pat. No. 4,580,692 discloses a general openable panel which must be broken open by pressure exerted on the openable panel before the liquid may be dispensed from the container. A scored edge around the openable panel permits the consumer to identify whether the container has been opened prior to purchase by observing whether the scored edge is broken or intact.

FIGS. 6–8 of U.S. Pat. No. 4,580,692 show that the closure element may be used to mash against the openable panel to break a scored edge around the periphery of the openable panel. In this embodiment, the consumer would mash n the closure element until an annular extension on the closure element breaks the openable panel from the metallic end about the peripherally scored edge.

Thus, openable panels and closure elements adapted to open the openable panels, in general, are known. However, prior art opening devices are incompatible with the more advantageous umbrella type closure structures. Thus, an openable panel and an opening closure element are needed which are adapted to the particularly advantageous structure of the umbrella type closure device shown in, for example, the U.S. Pat. No. 4,632,271.

SUMMARY OF THE PRESENT INVENTION

The present invention incorporates a flexible closure element and a metallic end with an openable panel, similar to the apparatus disclosed in U.S. Pat. No. 4,632,271 but also provides an improved flexible closure element which will simply and conveniently break an openable panel in the metallic end about a score line on the peripheral edge of the openable panel.

In a preferred embodiment, a score line is provided in the end wall to define an openable panel. Before dispensing the liquid in the container, the openable panel must be removed or retracted by separating the openable panel from the end wall along the score line.

The closure element of the preferred embodiment includes a central panel, a lever portion and a connecting portion connecting the central panel and the lever portion. The lever portion is initially forced as a generally upwardly-directed frusto-conical skirt portion and, when viewed in vertical cross-section, has a nose at its connection with the connecting portion. By positioning the closure element over the openable panel in the metallic end wall and inverting the umbrella shaped lever portion to generally downwardly directed position, the nose portion will sealingly contact the outer surface of an annular flange located radially outward from the periphery of the openable panel.

To assist in breaking the openable panel from the end wall, the preferred embodiment of the present invention provides that the central panel includes an outer surface, opposite the surface adjacent the nose portion, in which an annular guide projection is disposed radially inward from the circumference of the central panel and an annular inclined portion is disposed beginning slightly radially inward from the annular guide projection and sloping downwardly toward the center of the outer surface of the central panel. Together, the annular guide projection and the inclined portions define a channel means with the channel means located radially between the annular guide projection and the inclined portion. The channel is designed to be matingly engageable with the annular flange of the end wall. When pressure is exerted against the closure element surface, the flange of the end wall will ride up the channel, forcing the inclined portion against the openable panel to sever the openable panel from the end wall along the score line.

With the present apparatus, the consumer initially obtains the container with the flexible closure element sealed to the annular flange located around the openable panel with the inner surface of the central panel facing the end wall. The lever portion of the flexible closure element is in the downward position against the frusto-conically shaped end wall so the nose portion of the closure element is sealingly engaged against the flange of the end wall. The consumer first lifts the lever portion to release the nose portion of the closure element from the flange of the end wall, releasing the closure element from the container. During this operation, the closure element becomes inverted so the outer surface of the central panel, including the annular guide projection and inclined portion, is then located within the interior of the now inverted frusto-conically shaped closure element. In this position, the user flips the closure element relative to the end wall and repositions the outer surface of the central panel against the end wall with the annular guide projection surrounding the exterior surface of the annular flange of the end wall. By applying some force to the closure element against the end wall, the inclined portion of the central panel will then break the openable panel from the end wall along the score line. After the openable panel is separated from the wall, the user may lift the closure element from the container and dispense the fluid from the container through the newly created central opening.

Once the desired liquid is dispensed from the container, the user may again flip the closure element relative to the end wall so the inner surface of the central panel is again adjacent the end wall and the nose portion is adjacent the flange of the end wall. By then reinverting the frustoconical lever portion of the closure element, the closure element will again seal the nose portion against the flange to seal the newly created opening in the end wall.

The present invention thus contributes structural improvements to umbrella type closure elements to assist in separating an openable panel from the end wall. In this manner, the present invention provides a reliable method of detecting tampering in the container by including a score line in the end wall of the container to define an openable panel and provides the necessary tool, adaptable to the umbrella type closure structure, to separate the openable panel about the score line.

These and other advantages of the present invention will become apparent as consideration is given to the following detailed description taken in conjunction with the accompanying drawings.

BRIEF DESCRIPTION OF THE DRAWINGS

The closure device of the present invention will be more fully described with reference to the FIGURES in which.

DETAILED DESCRIPTION OF THE PREFERRED EMBODIMENTS

Figure 1:
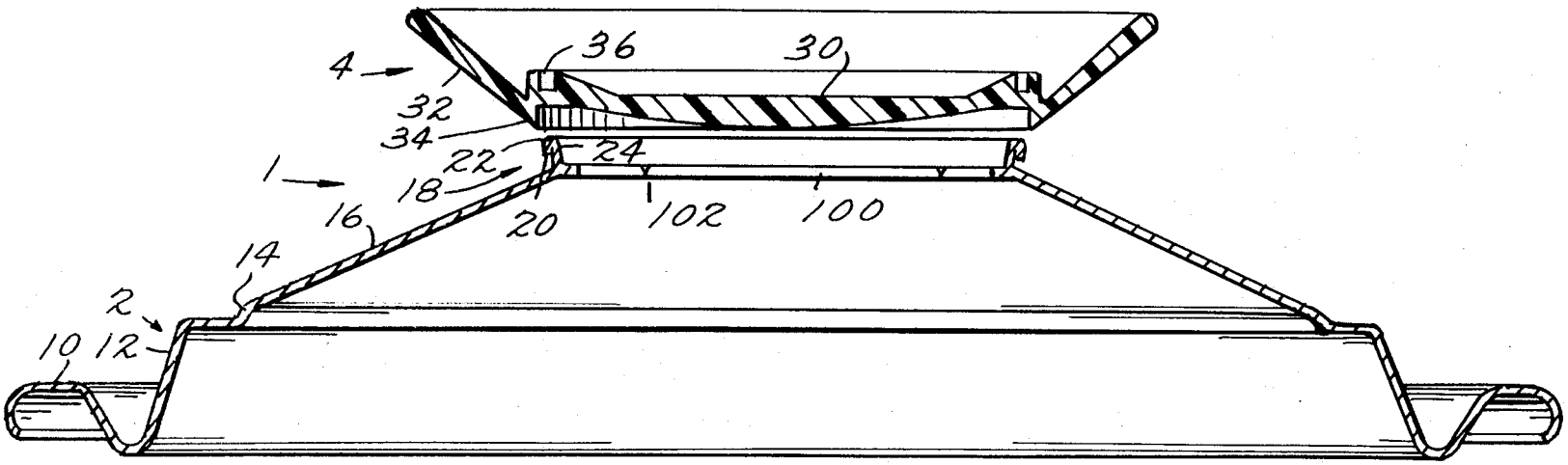
FIG. 1 is a cross-sectional view of one embodiment of the closure device of the present invention just prior to mating of the metallic end and the flexible closure element.

Turning now to the FIGURES, and particularly to FIGS. 1 through 4, a closure device 1 is illustrated. The closure device 1 is in two parts: a metallic end 2, having an openable panel 100, and a flexible closure element 4. The metallic end 2 preferably includes a curl 10, to enable the closure device I to be double seamed to a can body, as is practically standard in the industry. If desired, however, curl 10 could be eliminated, in such situations as where it is desired to adhesively bond the closure device 1 to the can body. A first inner panel wall 12 and second inner panel wall 16 give height and column strength to the end 2. The elevated conical height provided by panels 12 and 16 improves pouring characteristics of containers having the closure device 1 thereon. A stacking bead 14 provides stable vertical stacking of filled cans with closure 1 thereon.

The metallic end 2 has an openable panel 100 at its center defined by a scored portion 102, with a flange region 18 being formed at its central openable panel. The flange region 18 is upwardly and outwardly-directed with relation to the openable panel in the end 2 and includes an outer flange surface 20, a top flange surface 22 and an inner flange surface 24. As illustrated in FIGS. 1 through 4, the flange 18 is formed by beading or hemming metal of end 2 outwardly. As will be described below, this not an absolute requirement; alternatively, the flange 18 may be formed by inward beading.

The closure element 4 includes a central closing wall or panel 30 and a generally frustoconical lever member or skirt 32. The lever member 32 may be of increased thickness from its connection to the central wall 30 to its outer edge. However, it may take other forms, such as by having a generally circular thickened ring at the outer edge thereof, or by having constant thickness along its length, as will be described below. Lever member 32 is connected to central wall 30 by means of a transitional region 36 and a nose portion 34 is formed at the inner end of the lever 32. Preferably the nose 34 is at a diameter approximately equal to or slightly larger than the outer diameter of the flange 18. The diameter of the nose 34, however, may be slightly less than that of the flange 18, providing an interference fit in this case, for high-speed application of he closure element 4 to the end 2.

It has been found that improved sealing of the closure element 4 to the metallic end 2 may occur if the closure element 4 and the metallic end 2 are heated, such as to a temperature of between about 95° and 120° F. as these components are assembled.

Permissible materials for the metallic end 2 include those materials typically used in can making, such as steel and aluminum alloys, with preference being made to aluminum. The flexible closure element 4 may be formed of rubber or a plastics resin, such as polypropylene, polyethylene, and the like. Polypropylene is preferred.

To improve compatibility between the sealing surfaces of metallic end 2 and closure element 4, a surface coating material may be placed on the sealing surfaces of metallic end 2 and/or closure element 4. Typical of such materials are waxes, lacquers and the like. If necessary to reduce the gas transmission rate of the closure element 4, this element 4 may be coated with a low gas transmission rate material, such as polyvinyldene chloride (PVDC)or ethylene vinyl alcohol (EVOH).

Figure 2:
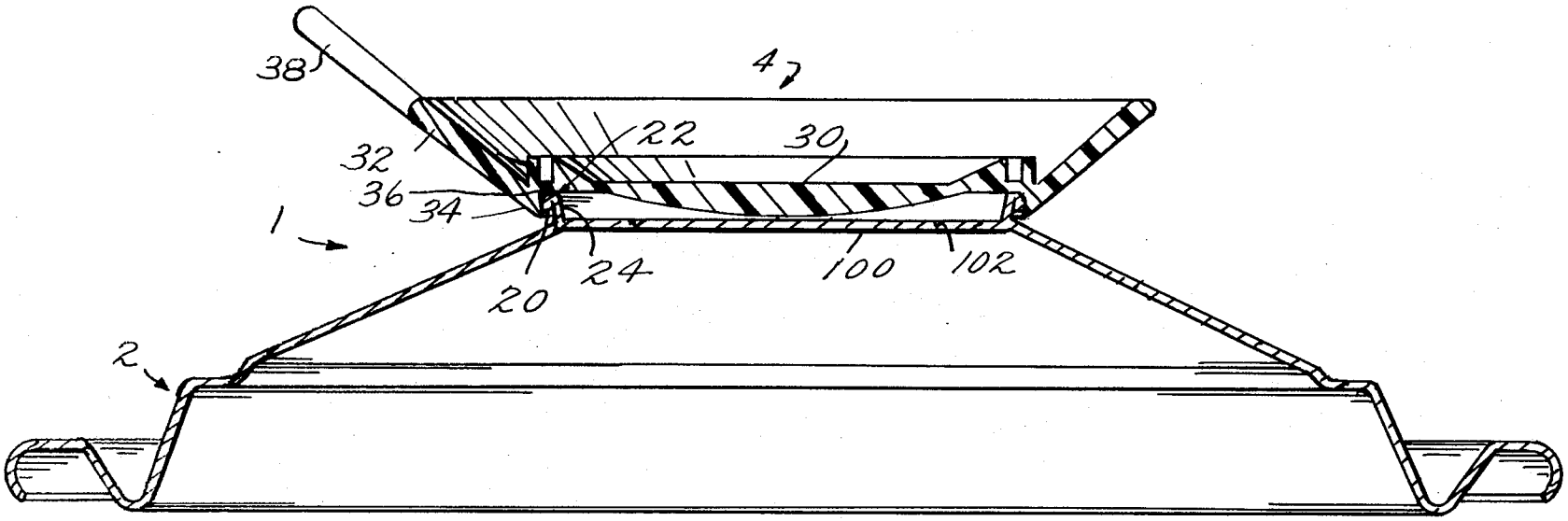
FIG. 2 is a cross-sectional view of one embodiment of the closure device of the present invention after placing the flexible closure element onto the metallic end.

In FIG. 2, the closure element 4 has been positioned onto the metallic end 2, but closing of the closure element 4 has not yet begun. As can be seen in this FIGURE, the transitional zone 36 of the closure element 4 is in contact with the top surface 22 and a rounded portion of the outer portion 20 of flange 18. Central panel 30 may also be in contact with the top wall 22 of the flange 18. However, the inner surface 24 of flange 18 is not in contact with the central panel 30, for reasons that will be more fully explained below. Thus, central panel 30 does not provide a plug for the central opening of the metallic end 2, but rather provides a cover therefor.

This FIGURE also illustrates the addition of a tab 38 connected at the outer end of lever 32. This tab 38, while optional, is preferred, in that tab 38 permits easier opening of the closure device 1 by providing an extension along a portion of lever 32 for a consumer to lift.

Figure 3:
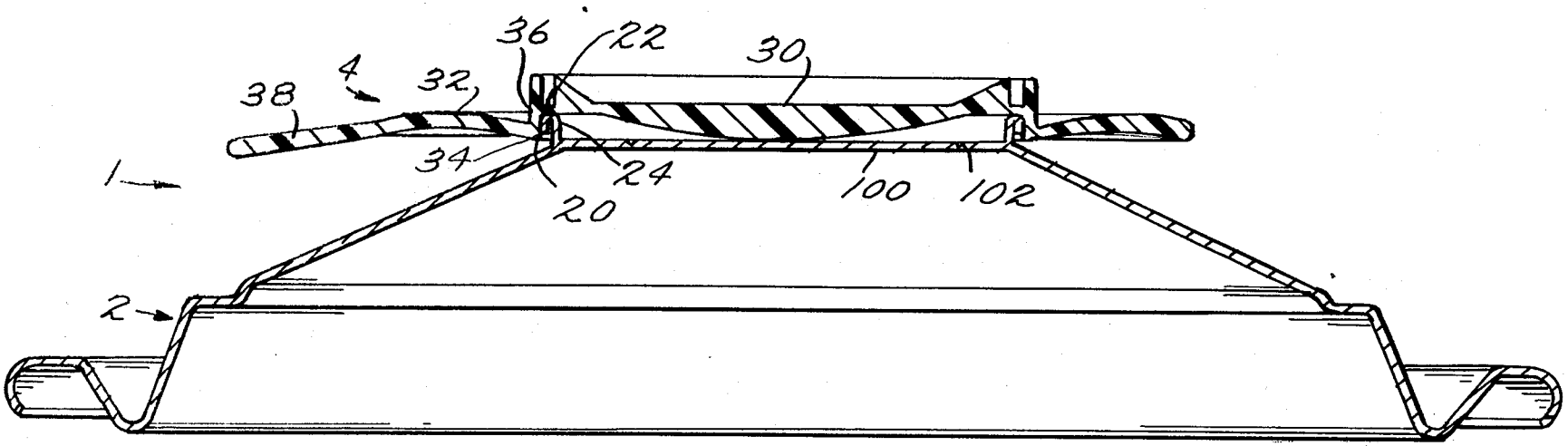
FIG. 3 is a cross-sectional view of one embodiment of the closure device of the present invention partially through the closing process.

In FIG. 3, the closure element 4 is in the process of being sealed onto flange 18 of metallic end 2. Nose 34 is approaching outer surface 20 of flange 18 while the transitional zone 36 remains in contact with flange 18 in the region previously mentioned. Central panel 30 remains out of contact with the inner surface 24 of flange 18.

Lever 32 has become bowed. This bowing comes from internal tension within the closure element 4. As previously shown, closure element 4 is molded in an upright or "reverse umbrella" position. As lever 32 is moved downwardly, such that closure element 4 becomes sealed onto metallic end 2, internal forces caused by the movement of lever 32 from its initially molded upright position through the horizontal and over-center and downwardly past the horizontal creates tension within lever 32, which tension acts to pull lever 32 and nose 34 closer to central panel 30, aiding in the sealing operation.

Figure 4:
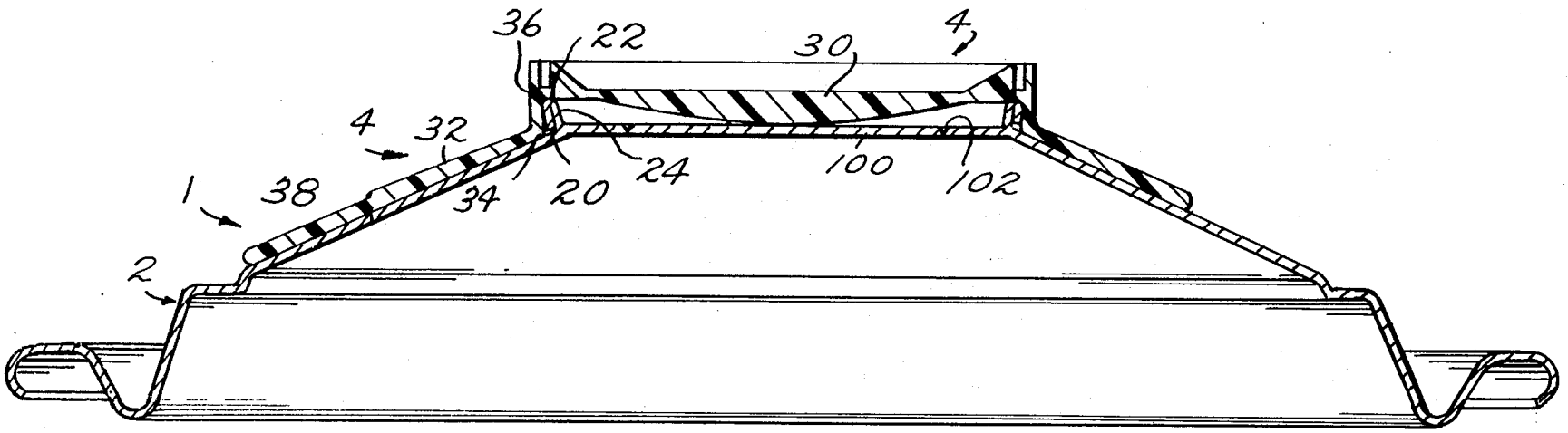
FIG. 4 is a cross-sectional view of one embodiment of the closure device of the present invention in the fully closed position.

In FIG. 4, closure device 4 has been fully sealed onto metallic end 2. Nose 34 is in sealing engagement with the outer surface 20 of flange 18. It should be noted that nose 34 does not extend completely under the edge 21, FIG. 7, of the flange 18. When closure element 4 is on metallic end 2 for an extended period of time, natural plastic deformation will occur. Thus, closure element 4 will tend to mold itself to the shape it is in. If nose 36 were positioned under edge 21, FIG. 7, plastic flow into this region would occur, making it extremely difficult to remove the closure element 4 from the metallic end 2, with added possibility of damage to the flange 18. Such plastic deformation, along with the potential damage to flange 18 upon removal of the closure element 4 from the metallic end 2, makes resealing the closure element 4 onto the metallic end 2 difficult and unreliable.

In addition to the sealing of nose 34 to outer surface 20, transitional region 36 is in sealing engagement with the remainder of the outer surface 20 and a region up to the tangent line of central panel 30 with the top surface 22 of the flange 18. Again, central panel 30 is not in sealing engagement with the inner surface 24 of flange 18.

In the completely sealed position, there remains tension within lever 32. Lever 32, after passing the horizontal or over-center position, does not return to an untensioned position, as in its as-molded "reverse umbrella" position. This residual tension in lever 32 helps maintain the tight seal between the nose 34 and the outer surface 20 of flange 18. This residual tension results, at least in part, from the inability of skirt 32 to rotate downwardly further, due to the firm contact against wall 16 of the outermost portion of skirt 32. It is theorized that, if lever 32 were unsupported, the closure element 4 would tend to creep off of end 2 when the closure device 1 is placed on a pressurized can.

Figure 5:
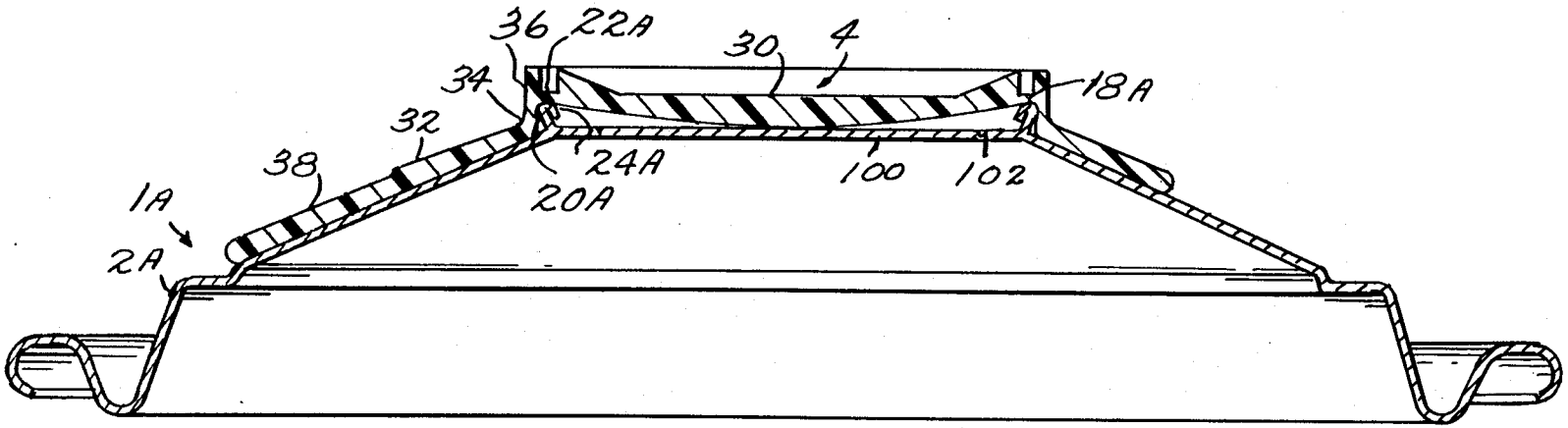
FIG. 5 is a cross-sectional view of one embodiment of the closure device of the present invention in the fully closed position, including a modified metallic end.

FIG. 5 illustrates the closed position of closure element 4 on a modified can end 2A. The modified end 2A has its flange region 18A beaded or hemmed inwardly, forming an outer surface 20A, a top surface 22A, and an inner surface 24A. In this modified closure device 1A, it is readily apparent that the nose 34 cannot hook under outer surface 20A, since there is no abrupt end to outer surface 20A, as this surface 20A is transitioned into wall 16.

Also, it should be again noted that transitional region 36 contacts the balance of outer surface 20A and a portion of the top surface 22A until the lower surface of central panel 30 becomes tangent with top surface 22A. Again, no sealing engagement exists between the central panel 30 and the inner surface 24A of flange 18A.

Figure 6:
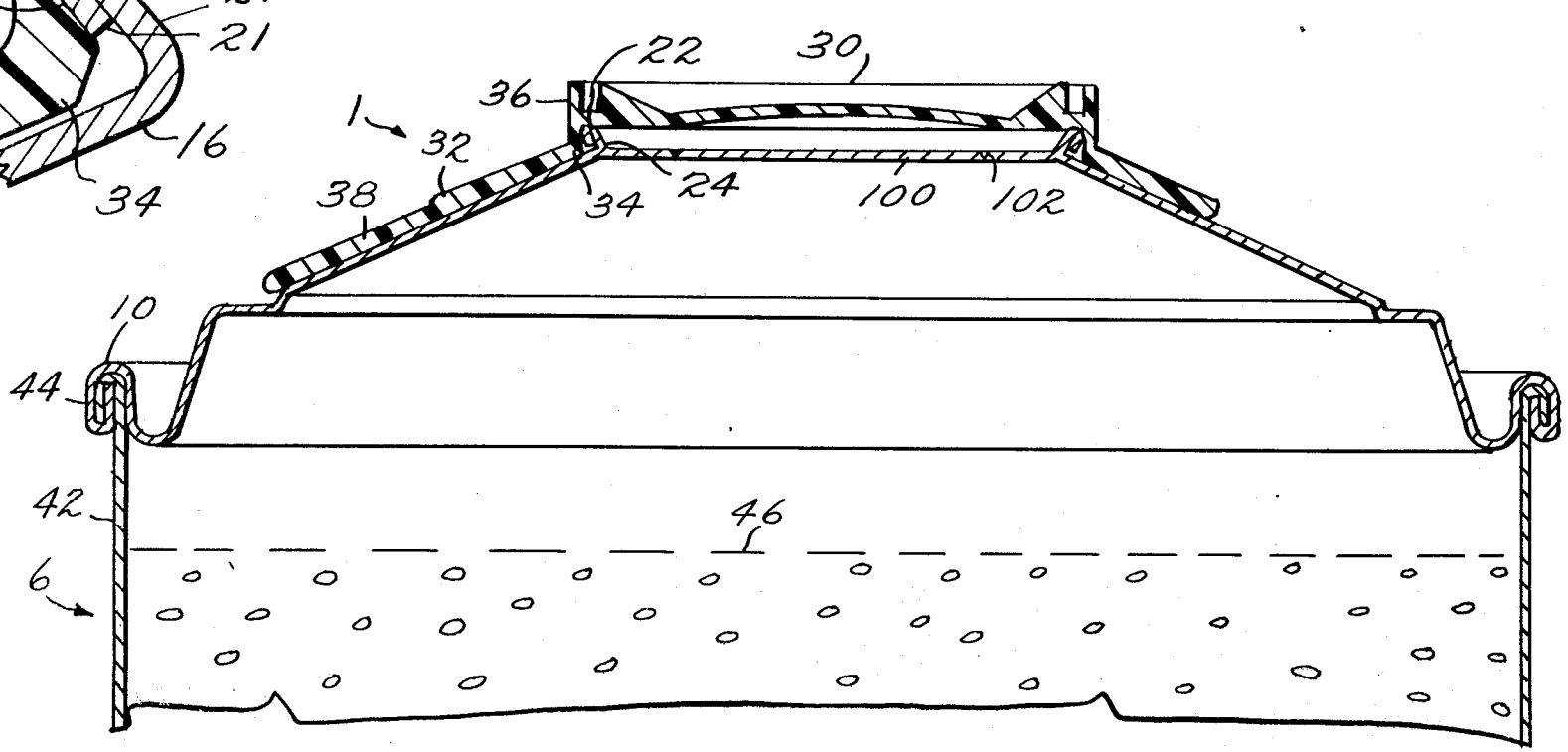
FIG. 6 is a cross-sectional view illustrating one embodiment of the closure device of the present invention on an internally pressurized can body.

FIG. 6 illustrates the sealing of closure device 1 onto a container body 6 having been filled with an internal pressure-generating material 46, such as a soft drink or beer. The sidewall 42 of can 6 includes a flange 44 which has not been double seamed to curl 10 in a conventional manner. Once the openable panel 100 has been removed (as described below) and the closure element resealed on the container, the newly created opening in the end 2 exposes the central panel 30 to the internal pressure within the container 6. The internal pressure within container 6 has cased central panel 30 to bulge outwardly slightly, with the tension caused by this internal pressure on central panel 30 causing added inwardly directed circumferential sealing between the nose 34 and the outer surface 20 of flange 18 and the transitional region 36 with its associated sealing regions 20 and 22. Thus, increased internal pressure within can 6 increases the seal of closure 1, rather than tending to cause seal failures.

Figure 7:
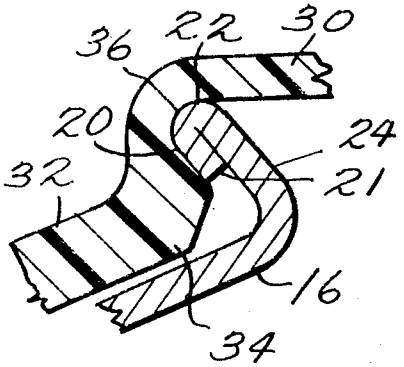
FIG. 7 is an expanded cross-sectional view of the flange region of FIG. 6, illustrating the sealing region of the closure device of the present invention.

FIG. 7 is an exploded view of the flange region of FIG. 6, more closely illustrating the sealing region between metallic end 2 and closure element 4 when positioned on a pressurized can 6. As can be seen in this FIGURE, nose 34 contacts a portion of outer surface 20 of the flange 18, but no portion of nose 34 is positioned under the end 21 of surface 20. Thus, there is no mechanical hook between metallic end 2 and closure element 4. The transitional zone 36 contacts the balance of outer surface 20 to a line on the top surface 22 of flange 18 where the central panel 30 becomes tangent to flange 18. Thus, no seal occurs between central panel 30 and inner surface 24 of flange 18.

The reason for this sealing arrangement becomes evident with an understanding of the opening of closure device 1 on internally pressurized can 6. Upon lifting tab 38 or a portion of lever 32, nose 34 and transitional zone 36 separate from flange 18 in the area of tab 38 or area of lifting of lever 32. This separation occurs only for about one quarter of the circumference of flange 18. Further, it permits controlled venting or escape of the internal pressure within can 6. The remainder of lever 32 may then be moved back to its as-molded "inverted umbrella" position and the closure element 4 lifted from the metallic end 2.

If central panel 30 were permitted to be in sealing engagement with inner surface 24 of flange 18, such that central panel 30 formed a plug for the opening defined by the removed openable panel 100, controlled venting would not occur by the lifting of tab 38 or a portion of lever 32. This would require that the entire lever 32 be returned to its upright position while internal pressure remained within the can 6, allowing the internal pressure within can 6 to blow off the closure element 4, which is not acceptable. It is thus important to confine the sealing area to the outer surface 20 of flange is and the top surface 22 of the flange 18 and avoid sealing along the plane inside surface 24 of flange 18.

Figure 8:
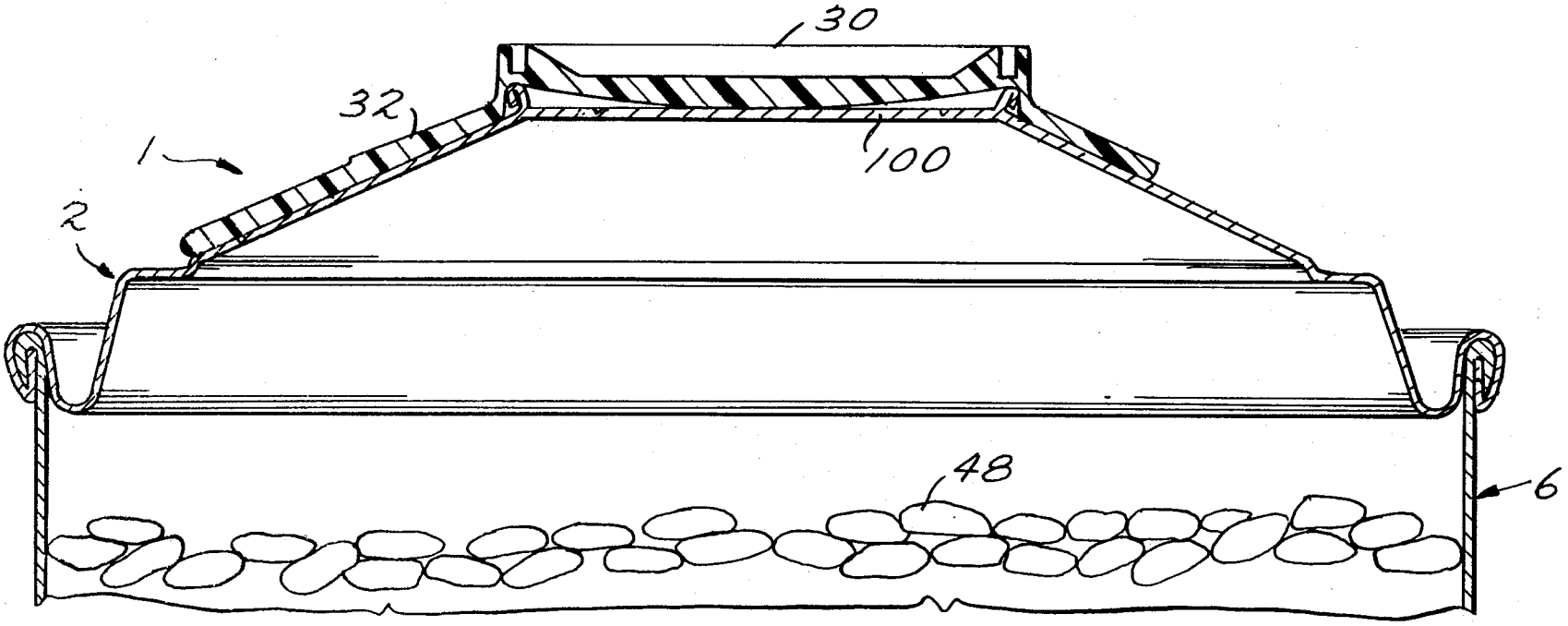
FIG. 8 is a cross-sectional view of one embodiment of the closure device of the present invention mounted on an unpressurized can.

FIG. 8 illustrates the use of the closure device 1 to seal a can 6 which contains a product which is not under internal pressure, such as water, peanuts 48 as shown, wine and the like.

While there may be no internal pressure within can 6, and thus the central panel 30 of closure element 4 is not outwardly deflected after removal of the openable panel 100, such that no additional locking is added to the closure element 4, as previously mentioned, the tension within lever 32 provided by the inverting of the closure element 4 upon itself still provides a sufficient seal for the closure device 1. In that regard, it should be noted that the relative positioning of the various portions of closure element 4 in relation to metallic end 2 in this embodiment are identical to that shown in FIG. 4, prior to the sealing of the closure device 1 onto a can body.

Figure 9:
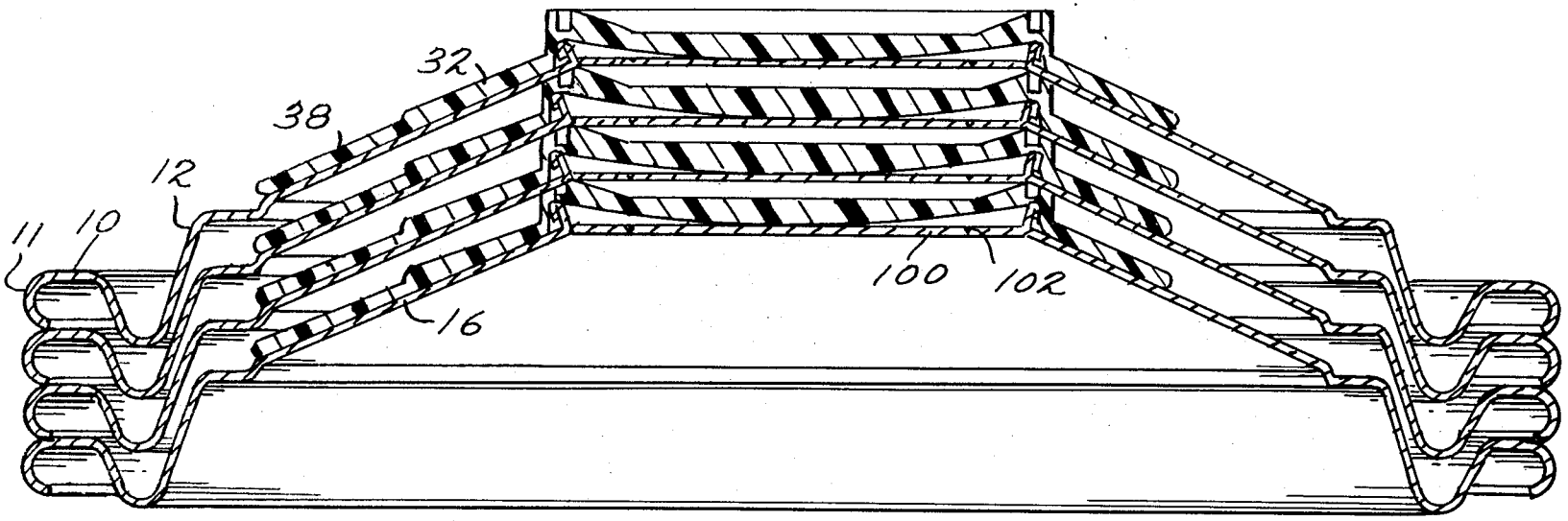
FIG. 9 is a cross-sectional view of a stack of closure devices according to the present invention.

FIG. 9 illustrates a plurality of closure devices 1 which are stacked upon each other. As can be readily seen, the only point of contact between adjacent closure devices 1 are at the outer edge 112 of the curl 10. There is no contact of the closure devices 1 between walls 16 and levers 32 or tabs 38 of adjacent closure devices 1.

Shuffling, or sideways displacement of a stack of ends, is controlled by the height of curl 10. The height of curl 10 is selected to permit stacking of closure devices 1 with only the edges 11 of curls 10 in contact. This height is selected to be greater than the vertical height of flange 18 with closure element 2 fitted thereon.

The ability to stack the closure devices 1 is important. The closure devices 1 are shipped with the closure elements 4 sealed onto the metallic ends 2. The closure devices 1 are shipped in paper-wrapped stacks or sleeves, typically containing from about 200 to about 400 closure devices 1. These closure devices 1 are used by a canner, such as a soft drink canner or beer canner, in typical high-speed can line filling operations, filling in the order of 800 to 2000 cans per minute. Only slight modifications of the tooling of these canners is required to accept the closure device 1 of the present invention. This is in contrast to other suggested resealable closure designs for cans, which typically take the form of a cap or closure element closing only a small opening in the center of the can through which filling of the can must take place, thus significantly extending the time necessary to fill the can and requiring a slow down of operating speeds, to speeds such as those typically encountered in bottling operations.

Thus, when employing the closure device 1 of the present invention, canners may retain their investment in canning equipment, with only minor modifications or adjustments, rather than a complete replacement of their can filling line with bottle-type filling machinery.

Figure 10:
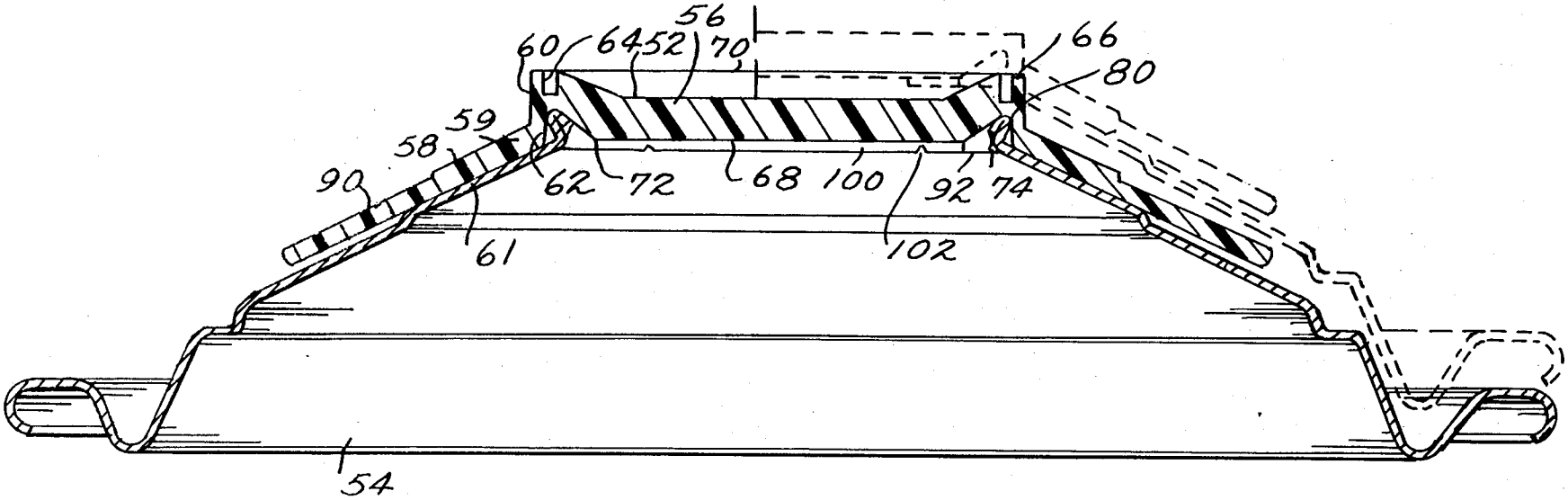
FIG. 10 is a sectional view in elevation of another embodiment of the present inVention.
Figure 11:
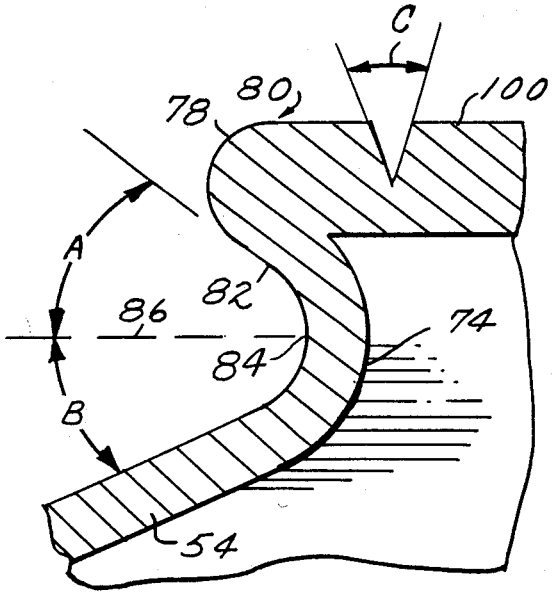
FIG. 11 is an enlarged detailed view of the flange of the embodiment of FIG. 10.
Figure 12:
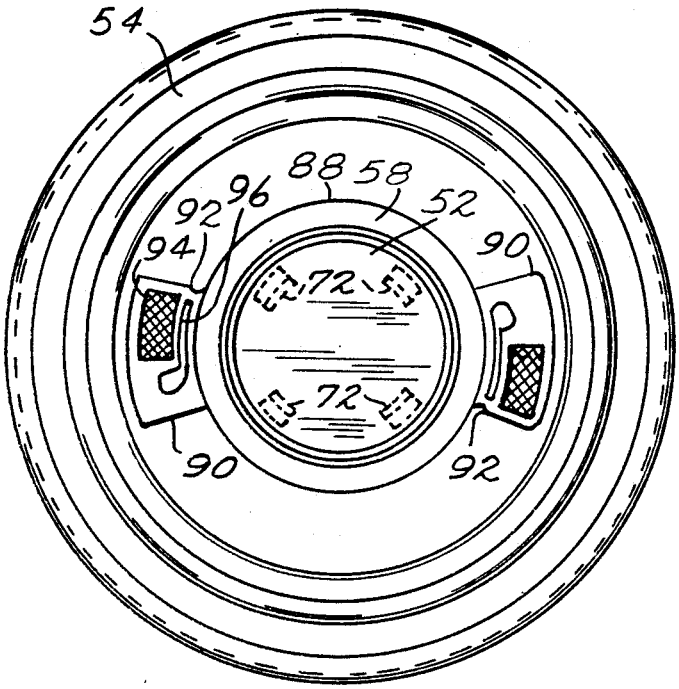
FIG. 12 is a top plan view of the embodiment of FIG. 10.

With reference now to FIGS. 10–12, another embodiment of the present invention is illustrated. As shown in FIG. 10, the closure device 50 includes a flexible closure element 52 similar in structure to the flexible closure element of the previous embodiment, and a metallic end wall 54.

The flexible closure element 52 is preferably made of a relatively stiff nucleated polypropylene, such as that currently available from Eastman Kodak, and identified by that company as TENITE polypropylene, P7673838A, a nucleated version of P763-648G, one-half percent talc. The closure element 52 includes a central panel portion 56, a lever portion in the form of a skirt 58 and a transitional connecting portion 60 connecting the lever portion 58 with the central panel 56. The lever portion 58 is of substantially uniform thickness. With this arrangement, when the closure element 52 is installed on the metallic end wall 54, after the openable panel 100 has been removed, to close the opening 76 of the end wall 54, the lower surface 59 of lever portion 58 will be maintained in secure and sealing contact with the subjacent annular surface portion 61, of the end wall 54. As a result, the undesirable ingress of dirt and debris between the lever portion 58 and the surface portion 61 will be completely or substantially completely precluded. Activation of lever 58 down past its desired position is prevented, by the outermost portion of lever 58 coming into contact with surface portion 61. Thus, a tight seal of the closure element 52 onto end 54 is provided, as described above. The tight surface contact between the inner portion of lever 58 and surface 61 substantially reduces or eliminates the possibility of uncontrolled venting of the closure device 50, for example, when subjected to a downwardly directed axial load on center panel 56.

The connecting portion 60 of the flexible closure element 52 includes a nose portion of the previous embodiment in that the nose portion 62 completely occupies an annular recess on the exterior of neck 74 of the opening 76. This is effected by conforming the nose portion 62 with the radius of curvature of the exterior of the neck portion 74 during closing of the closure device 50. This occurs in spite of the fact that the nose 62 is molded with a radius of curvature slightly less than that of neck portion 74. It is believed that the displacement of nose 62 causes it to conform to the profile of neck 74. The connecting portion 60 also includes an annular recess 64 having the same radius of curvature as the bead 78 of the inwardly turned flange 80. With this arrangement, when the flexible closure element is disposed as illustrated in FIG. 10 on the end 54, a fluid-tight seal is achieved on the flange 80.

The central panel 56 is formed with a frustoconical annular wall 66 extending in a smoothly continuous manner from the annular recess 64 to the inner surface 68 of the pane 156. Surface 68 extends substantially parallel to the exterior surface 70 of the central panel 56. With this arrangement, controlled venting can be achieved since the material of the panel 56 is spaced inwardly from the inner surface of the opening 76 and no contact with surface 77 is made when the closure device 50 is under pressure. Additionally, the relatively constant thickness of central panel 56 towards its periphery, as opposed to the tapering of the previous embodiment, resists upward bulging at central panel 56 when the closure device is positioned on a container under internal pressure. This helps prevent undesired venting of the closure device 50, should the closure device 50 be subjected to a downwardly directed force on central panel 56.

To assist in locating the flexible closure element 52 in the opening 76 of the end wall 54 after the openable panel 100 has been removed, a plurality of locating lugs 72 are formed to extend substantially perpendicularly relative to the outer surface 70 and are spaced slightly inwardly from the neck 74 of the opening 76 when the flexible closure element 22 is installed on the opening 76 of the end wall 54. The disposition of the locating lug 72 is shown in broken lines by way of example, in FIG. 12.

With reference now to FIG. 11, there is shown in greatly enlarged detail a sectional view of the flange 80 of the metallic end wall 54 with the flexible closure element 52 removed. The manner of forming flange 80 with metal forming tooling so that the flange will assume the shape illustrated in FIG. 11 will be apparent to those skilled in this art. It is important, however, in a preferred embodiment, that certain relationships be observed.

A scored portion 102 is shown dividing the openable panel 100 from the flange region 80. The method of forming the scored portion is known to those skilled in the art. The angle C of the scored portion shown in FIG. 11 is preferably 60 degrees.

Most importantly, it has been found that the angle A in FIG. 11, the angle at which the smooth annular surface 82 extends upwardly from the plane surface indicated in the broken line at 86 should be between about 30° and about 40° and preferably about 35°. The plane indicated at 86 is that plane which passes through an annular region defined by the smallest diameter of the neck 74 in the opening 76. It has been found that where this angular relationship is maintained, the flexible closure element 52 of FIG. 10 is retained in sealing engagement with the flange 80 at unexpectedly high pressures and, in some instances, the closure element 52 remains in place on the flange even after the metal of the container has failed due to excess pressure. Where the angle A is less than about 30°, it becomes difficult to remove the closure element 52 from metallic end 54. Where the angle is greater than about 40°, and where the contents of the container are pressurized, the flexible closure element exhibits a tendency to slide over the flange 80. It will thus be seen that the angular range of about 30°–40° and preferably about 35° is essential to successful retention of the flexible closure element 52 on the end wall 54.

It will be appreciated from FIG. 11 that the upper end of the beaded flange 80 includes the rounded portion 78 which cooperates with the surface 64 of the closure element 52 in that the surface are of substantially complementary configuration in size, shape and curvature. As a result, when the closure element 52 is installed on the flange 80 of end wall 54, there will be substantially full and complete contact between the rounded surface 64 of the closure element 52 and the surface 78 of the flange 80 upon initial positioning of the closure element 52 over the opening 76 prior to inverting the lever portion 58 to the generally downwardly directed position as illustrated in FIG. 10.

FIG. 11 also illustrates angle B, which is the angle of upwardly and inwardly directed wall 61. This angle B should range between about 25° and about 35°, and preferably is about 25°. If angle B exceeds about 35°, stackability of the closure device 50 is impaired. If the angle B is less than about 25°, pourability through the metallic end 54 is impaired.

The combined angle formed by angles A and B will thus be seen to be in the range of about 55° to about 75°, and preferably about 60°.

With reference now to FIG. 12, there is shown a top plan view of the flexible closure element 52 of this embodiment. As illustrated, the outer periphery 88 of the lever portion 58 may include diametrically located pull tabs 90 which incorporate a tamper-evident feature in the form of a frangible connecting member 92 spanning the tip of the main body 94 of the pull tab 90 and a paced portion 96 of the pull tab which is located on the periphery 88 of the lever portion 58 and is formed integrally therewith. Preferably, as shown, two spaced pull tabs 90 would be provided although, it will be understood that in many applications a single pull tab could suffice.

With this tamper-evident feature, a user will be able to visually inspect the end wall 54 and, where the bridge 92 has been severed, this will indicate that the closure element has been tampered with.

It will be noted that unlike a purely mechanical hinge, the hinge about which the outer portion 58 is rotated in moving from the upwardly directed position similar to that of FIG. 1 of the previous embodiment and the downwardly directed position as illustrated in FIG. 10 will lie within the area of the connecting portion 60 and should be below the center of the radius of curvature of the surface portion 64 when the closure element 52 is viewed in a side elevation. With this arrangement, the nose 62, when the lever portion 58 is in the upwardly directed position, will be substantially if not completely out of contact with the outermost portion of the flange 80 when the closure element 52 is first installed on the flange 80. Thus, with relatively simple modifications, presently installed closure machines can be employed with this flexible closure element.

As with the previous embodiment, the closure device of FIGS. 10–12 are capable of mechanical stacking as can be appreciated by considering the stacking arrangement exemplified in FIG. 10 where the dotted line device is in one such stacked position.

While emphasis has been placed on closure devices for metallic cans, it should be noted that composite cans and other similar structures may also employ the closure device 1 of the present invention.

From the foregoing, it is clear that the present invention provides a resealable closure device which may be employed on standard can bodies and which overcomes the limitations and deficiencies of the previously known resealable closure devices for cans.

Figure 13:
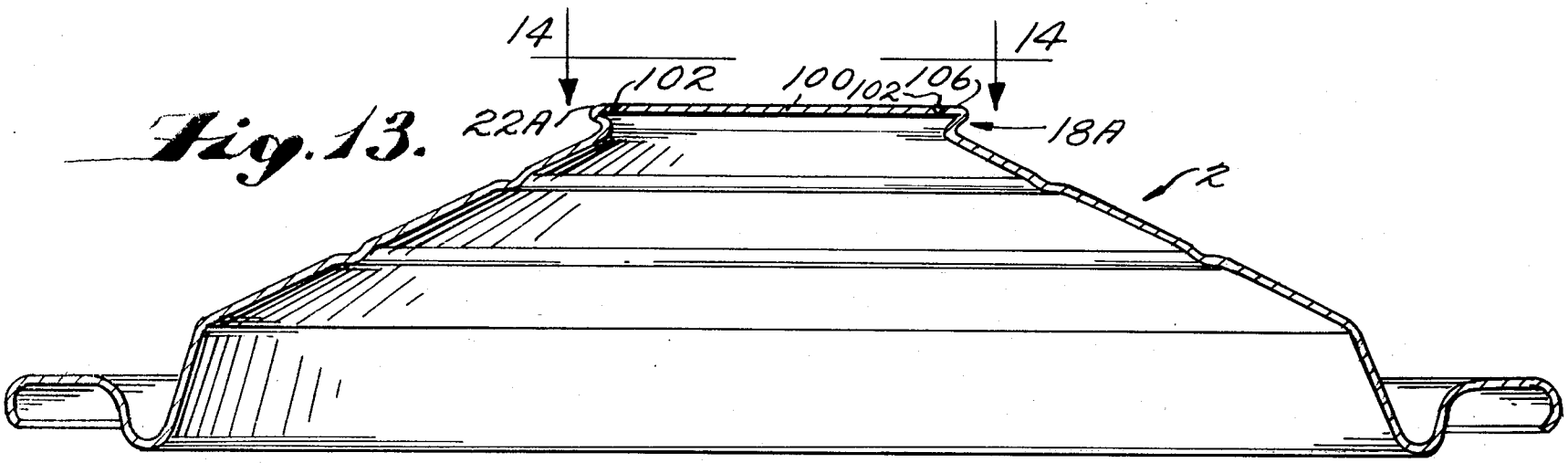
FIG. 13 is a side cross-sectional view of the metallic end of the present invention.
Figure 14:
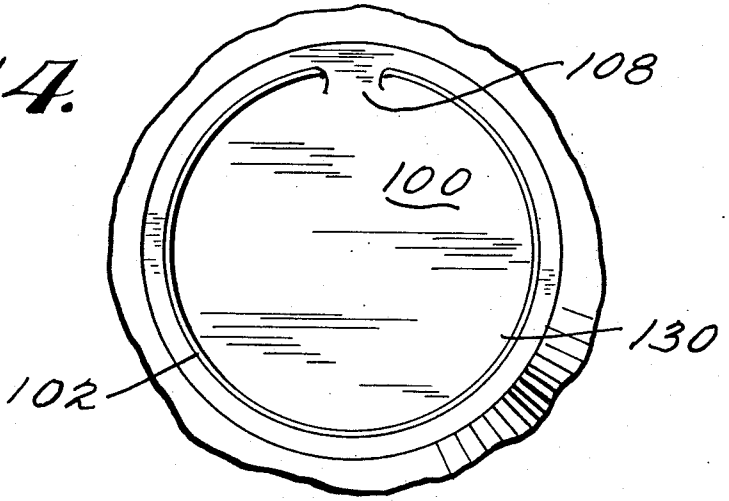
FIG. 14 is a top view of the openable panel of the present invention.

FIGS. 13–18 particularly illustrate the openable panel 100 in the end wall 2 and a further embodiment of the closure element 104 adapted to separate at least a portion of the openable panel 100 from the end wall 2. The openable panel 100 and the improvements to the closure element described below are preferably included in each of the previously discussed embodiments. FIG 13 shows the end wall having the annular flange 18A surrounding the openable panel 100. The flange 18A includes the top surface 22A abutting a scored portion 102 in the end wall 2 which defines the periphery 106 of the openable panel. The scored portion 102 may be a "V-shaped" groove cut partially through the thickness of the end wall at, for example, 60 degrees relative to the top surface 22A of the annular flange. The groove may be cut in a complete circular pattern or may be cut in an incomplete circular pattern as shown in FIG. 14. The incomplete circular pattern is preferred since it leaves a hinge portion 108 to secure a portion of the openable panel 100 against the end wall after separating the openable panel from the end wall. Separating just a portion of the openable panel from the end wall prevents the openable panel from falling into the container after separation and from being inadvertently swallowed by a user drinking directly from the container.

Figure 15:
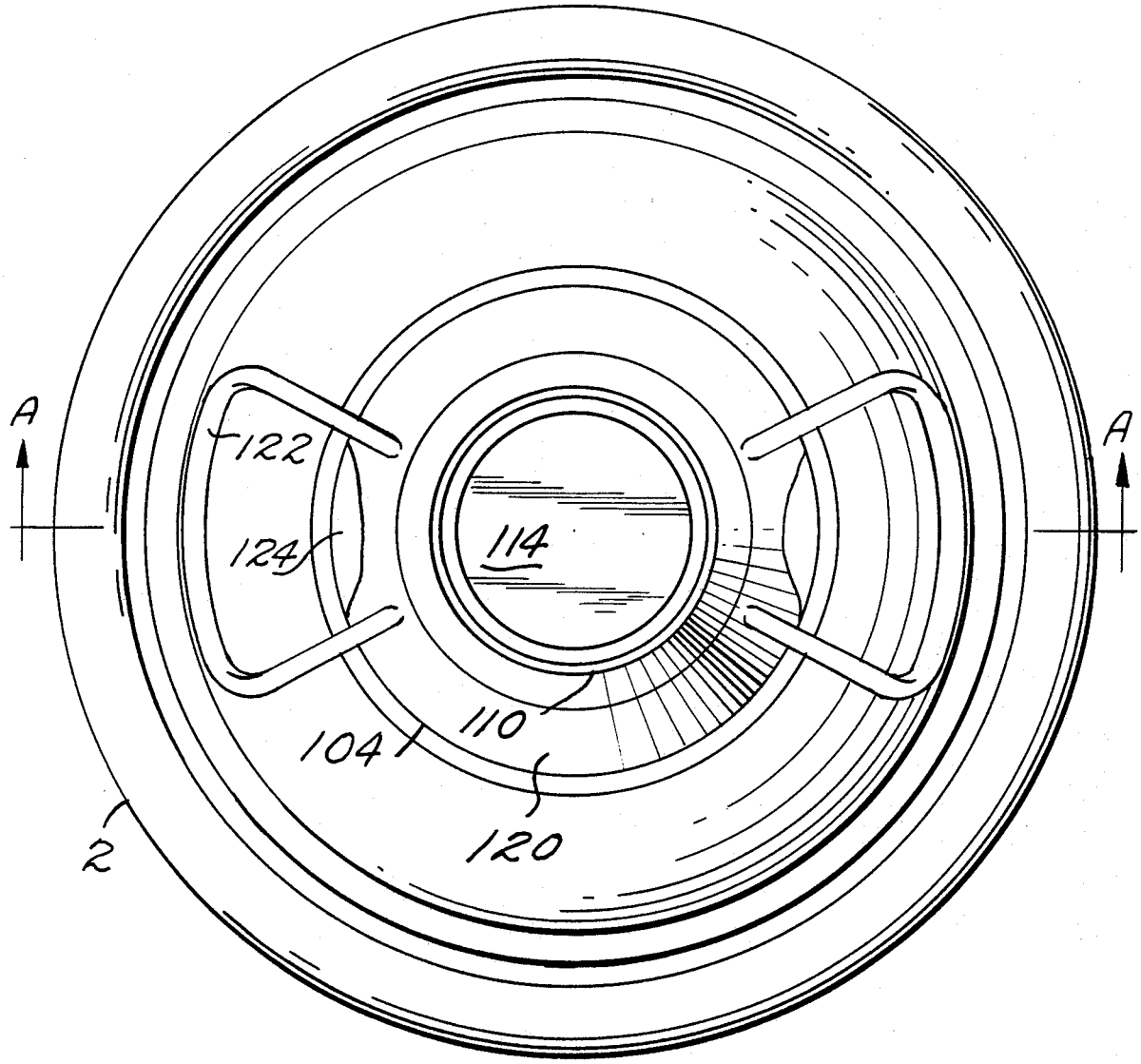
FIG. 15 is a top view of the closure element of the present invention.

FIG. 15 illustrates the improved umbrella type closure element 104 according to the present invention. The closure element includes a central panel 114 having an inner surface 116 and an outer surface 118. The closure element further includes a conical lever member 120 and a transition region 112 connecting the central panel 114 with the lever member 120 in the same manner described above. The sealing operation of the closure element on the end wall of the container is identical to the operation described above. Together, the end wall 2 and the improved closure element 104 provide a tamper evident openable panel 100 and a tool for opening the openable panel.

Figure 16:
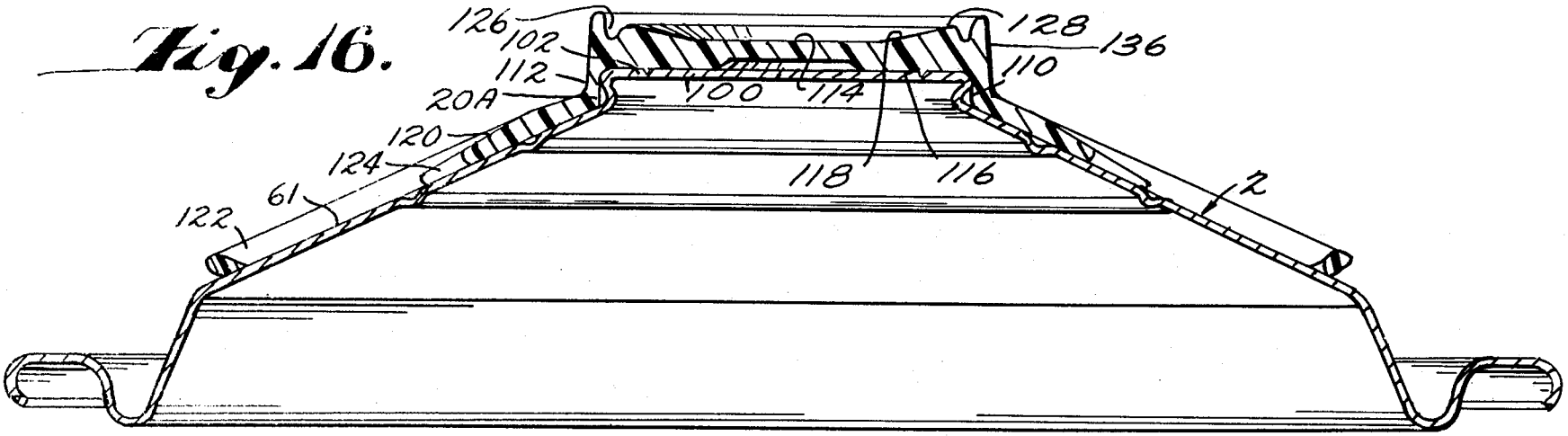
FIG. 16 is a cross-sectional view of the closed end wall with the closure element of the present invention, viewed along the plane A—A of FIG. 15.
Figure 17:
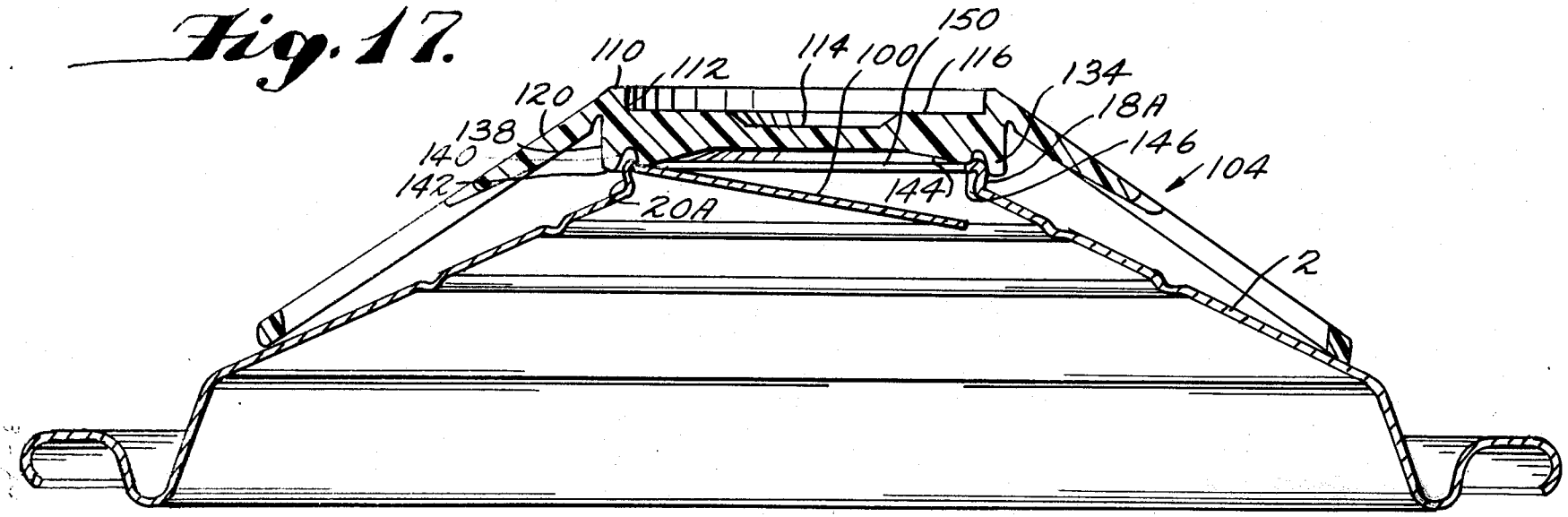
FIG. 17 is a cross-sectional view of the opened end wall with the outer surface of the closure element engaging the end wall, viewed along the plane A—A of FIG. 15.
Figure 18:
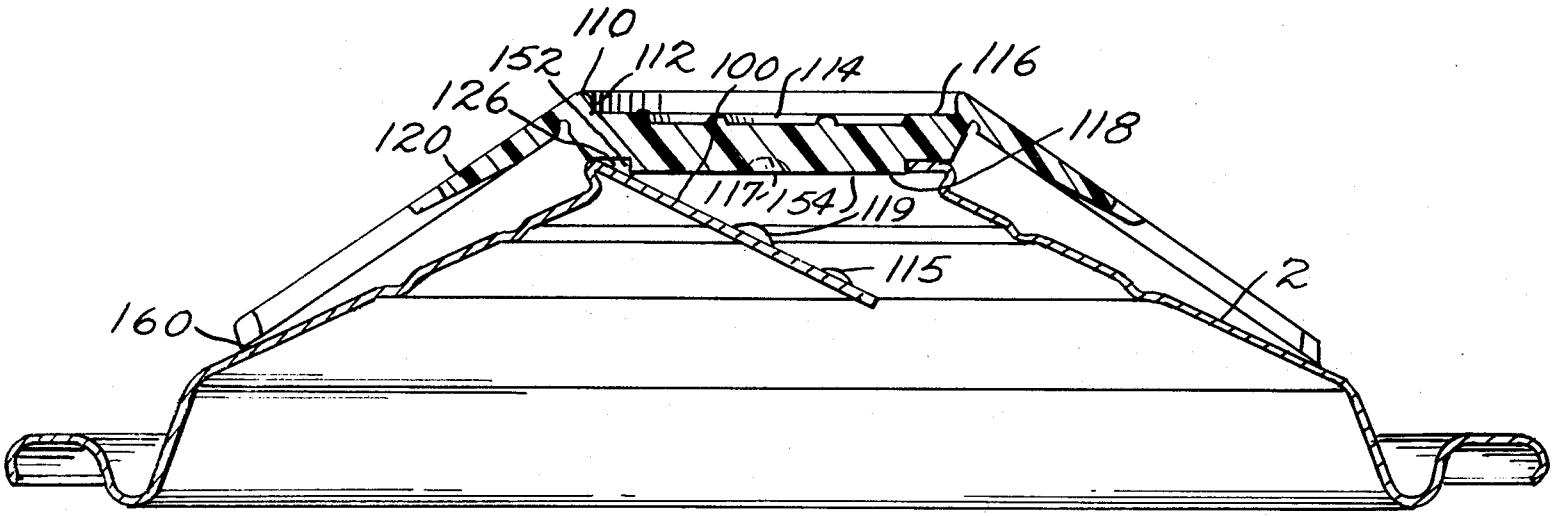
FIG. 18 is a cross-sectional view of another embodiment of the outer surface of the closure element of the present invention.

FIGS. 16–18 are cross sectional views looking at the closure device along the plane shown in FIG 15. FIGS. 16 and 17 illustrate a first embodiment of the present invention. FIG. 16 shows the closure element attached to the container to seal the opening or openable panel in the end wall and FIG. 17 shows the closure element engaged with the container to separate the openable panel from the end wall.

The consumer purchases the container with the inner surface 116 of the closure device facing the end wall 2 as illustrated in FIG 16.–The closure element 104 is secured to the container by the nose portion 110 of the closure element being in sealing engagement with the outer surface 20A of the annular flange 18A. The lever member 120 is in the downward position relative to the container and is substantially flush with the frusto-conical annular section 61 of the end wall 2. The user then lifts the lever member away from the annular surface 61 of the end wall using the handles 122 as necessary. Note that the lever member of the closure element includes cutouts 124 near the handles 122 to make grasping the handles of the closure element easier for the user. As the user lifts the lever member, the engagement structure of the closure element operates in the same manner illustrated in FIG. 3 and described above with respect to FIG. 3. The user continues to raise the lever member until it reaches the position shown in FIG. 2 and described above with respect to FIG. 2.

Once the user completely raises the lever member 120 to the fully upright position, the closure element is freed from the container, revealing the openable panel 100 in the end wall 2. With the lever member remaining in the upright position, the user then flips the closure element over so the outer surface 118 of the central panel 114 on the closure element 104 is facing the end wall 2 and the lever member is substantially flush with the annular section 61 of the end wall 2. In this position, the outer surface 118 of the central panel 114 is structured to separate the openable panel 100 from the end wall about the scored portion 102. The outer portion includes a channel 126 which is engageable with the annular flange 18A. There are may possible designs of the channel and two of these possibilities are described with respect to FIGS. 17 and 18 below.

The critical feature of the channel 126 is its ability to lower the central panel to a point where an extension 128, secured to or inherent in the central panel, may direct a force onto the openable panel in the vicinity of the scored portion to separate the openable panel from the end wall. In FIG. 17, the closure element 104 is shown separating the openable portion 130 of the openable panel 100 from the end wall, leaving the remaining hinge portion 108 attached. The outer surface 118 is illustrated facing the end wall with the channel 126 sliding over the flange 18A. The outer surface 118 of the central panel has an annular guide member 134 surrounding the outer surface 118 at its peripheral edge 136. The annular guide member 134 extends perpendicularly from the outer surface 118 of the central panel and includes an exterior side 138, an interior side 140 and a tip region 142. The exterior side supports the annular guide member, the interior side 140 slides along the outer surface 20A of the flange 18A on the end wall 2, and the tip region aligns the channel with the flange 18A.

The channel 126 is directed onto the flange region by the interior side 140 of the annular guide member following the outer surface 20A of the flange 18A when the user exerts pressure onto the central panel 114 of the closure element 104. The tip region 142 is preferably rounded to encourage the outer surface 20A of the flange 18A to enter the channel 126. As the flange region travels up the channel 126 by the pressure exerted on the closure element, an extension 128 contacts the openable panel 100 ad breaks the openable portion 130 of the openable panel 100 from the end wall about the scored portion 102.

The particular extension illustrated in FIG. 17 is an annular inclined portion 144 on the outer surface 118 of the central panel 114. The inclined portion 144 has an apex 146 in the vicinity of an slightly radially inward of the score line on the end wall. As the flange region progresses along the channel, the apex 146 of the inclined portion 144 will contact the openable panel and will separate the openable portion 130 from the end wall. The hinged portion 130 of the openable panel Will remain secured to the end wall and will be increasingly rotated clockwise with respect to FIG. 17 as the user continues to apply pressure to the closure element. When the flange region has fully progressed through the channel 126, the apex 146 of the inclined portion 144 will have rotated the openable panel 100 about the hinged portion 132 to a position substantially perpendicular to the plane of the newly created opening 150 in the end wall.

Once the closure element has fully retracted the openable panel 100 from the end wall 2, the user may lift the closure element from the container and dispense the contents of the container through the opening 150. After dispensing the desired contents from the container, the user again flips the closure element over so the inner surface 116 is facing the newly created opening 150 in the end wall 2. In this position, the lever member 120 will extent away from the container in an inverted frusto-conical shape as shown in FIG. 1. The user may then reseal the container in the same manner as shown and described with respect to FIGS. 1–8 above.

FIG. 18 illustrates an alternative embodiment of the channel structure of the closure element. In FIG. 18, the user has already removed the closure element from the initially sealed position and has flipped the closure element so the outer surface of the central panel faces the end wall in preparation for opening the container. In FIG. 18, the channel 126 is not defined by an annular guide member as the structure in FIG. 17 was. Instead, the channel 126 is open at one side and is bordered by a circumferential side 152 of a button 154 at its opposite side. The button 154 of FIG. 18 replaces the inclined portion 144 in FIG. 17, yet serves the same purpose. As the user exerts pressure on the closure element toward the end wall, the button, which is of slightly smaller diameter than the openable panel, contacts the openable panel and breaks the openable portion 130 of the openable panel 100 from the end wall about the scored portion 102. Again, a hinged portion 108 of the openable panel remains attached to the end wall to prevent the openable panel from falling into the container.

The panel 100 includes a centering dimple 119 which acts with corresponding centering recess 117 on surface 118 to facilitate location of the closure on end wall 2.

A pressure point 115 is also included on panel 100 to concentrate opening force in one area of panel 100.

The embodiment of FIG. 18 does not include an annular guide member to assist the user in aligning the button 154 with the openable panel 100. The lever member 120, however, will provide the user with sufficient guidance to locate the button 154 on the openable panel in the vicinity of the score line 102. As the user lays the closure element onto the end wall with the outer surface 118 facing the end wall, just prior to separating the openable portion 130 from the end wall, a portion 160 of the lever member 120 will contact the annular surface 61 of the end wall 2 to radially align the button 154 with the openable panel 100. Then, by applying pressure to the closure element, the user can break the openable portion 130 from the end wall and rotate the openable panel 100 to a position substantially perpendicular to the plane of the newly created opening 150. Once the closure element of FIG. 18 sufficiently opens the openable panel, the user may dispense the desired contents of the container and reseal the container as described above.

While the applicant has described the invention in connection with what the applicant considers the most practical preferred embodiment, the applicant does not limit the invention to the disclosed embodiment but, on the contrary, intends the invention to cover various modifications and equivalent arrangements included within the spirit and scope of the appended claims.

What is claimed is:

1. A closure device for a can comprising a metallic end wall, having an openable panel defined by a scored portion of said end wall, and a flexible closure element, said openable panel being substantially surrounded by a beaded flange means that flares outwardly relative to said openable panel, said beaded flange means including an exterior surface portion, said end wall including a wall portion surrounding said flange means with said wall portion extending at a selected angle relative to said exterior surface portion of said flange means, said flexible closure element having a central panel, a lever portion and a connecting portion connecting said central panel with said lever portion, said lever portion being initially positioned in a first position, when said central panel is generally horizontally disposed, as a generally upwardly directed frustoconical skirt portion and having, as viewed in vertical cross-section, a nose at its connection with said connecting portion, said metallic end wall and said closure element being constructed and arranged such that, upon positioning said closure element over said openable panel of said metallic end wall and moving said lever portion to a second position including, when said central panel is generally horizontally disposed, moving said lever portion to a generally downwardly directed position, said nose portion will sealingly engage at least a continuous annular part of said exterior surface portion of said flange means, said wall portion of said metallic end wall having a substantially frustoconical annular section extending outwardly from said flange means and said lever portion having a smooth surfaced section which intimately engages said substantially frustoconical annular section of said end wall when said lever portion is moved to said second position so as to substantially prevent ingress of dirt and the like between said lever portion in said second position and said annular section of said wall portion, said central panel including channel means and extension means, said channel means matingly engageable with said beaded flange means for directing said extension means against said openable panel, with said extension means separating at least a portion of said openable panel from said end wall about said scored portion when said extension means engages said openable panel.

2. A closure device for a can comprising a metallic end wall having an openable panel defined by a scored portion of said end wall, and a flexible closure element, said openable panel being substantially surrounded by a beaded flange means that flares outwardly relative to said openable panel, said flange means including an exterior surface portion, said end wall including a wall portion surrounding said flange means with said wall portion extending at a selected angle relative to said exterior surface portion of said flange means;

said flexible closure element having a central panel, a lever portion and a connecting portion connecting said central panel with said lever portion, said lever portion being initially positioned in a first position, when said central panel is generally horizontally disposed, as a generally upwardly directed frustoconical skirt portion and having, as viewed in vertical cross-section, a nose at its connection with said connecting portion, said metallic end wall and said closure element being constructed and arranged such that, upon positioning said closure element over said openable panel of said metallic end wall and moving said lever portion to a second position including, when said central panel is generally horizontally disposed, moving said lever portion to a generally downwardly directed position, said nose portion will sealingly engage at least a continuous annular part of said exterior surface portion of said flange means, said selected angle between said wall portion and said exterior surface portion of said flange means lying within the range of about 55°–75°, said central panel including channel means and extension means, said channel means matingly engageable with said beaded flange means for directing said extension means against said openable panel, with said extension means separating at least a portion of said openable panel from said end wall about said scored portion when said extension means engages said openable panel.

3. A closure device for a can comprising a metallic end wall having an openable panel defined by a scored portion of said end wall, and a flexible closure element, said openable panel being substantially surrounded by a beaded flange means that flares outwardly relative to said openable panel, said flange means including an exterior surface portion, said end wall including a wall portion surrounding said flange means with said wall portion extending at a selected angle relative to said exterior surface portion of said flange means, said flexible closure element having a central panel, a lever portion and a connecting portion connecting aid central panel with said lever portion, said lever portion being initially positioned in a first position, when said central panel is generally horizontally disposed, as a generally upwardly directed frustoconical skirt portion and having, as viewed in vertical cross-section, a nose at its connection with said connection portion, said metallic end wall and said closure element being constructed and arranged such that, upon positioning said closure element over said openable panel of said metallic end wall and moving said lever portion to a second position including, when said central panel is generally horizontally disposed, moving said lever portion to a generally downwardly directed position, said nose portion will sealingly engage at least a continuous annular part of said exterior surface portion of said flange means, said end wall having a neck portion, radially adjacent said openable panel, of minimum diameter relative to said openable panel, said exterior surface portion of said flange means extending at a selected angle of between about 30° and about 40° to a plane passing through said neck portion, said central panel including channel means and extension means, said channel means matingly engageable with said beaded flange means for directing said extension means against said openable panel, with said extension mean separating at least a portion of said openable panel from said end wall about said scored portion when said extension means engages said openable panel.

4. A closure device for a can comprising a metallic end wall having an openable panel defined by a scored portion of said end wall, and a flexible closure element, said openable panel being substantially surrounded by a beaded flange means that flares outwardly relative to said openable panel, said flange means including an exterior surface potion, said end wall including a wall portion surrounding said flange means with said wall portion extending at a selected angle relative to said exterior surface portion of said flange means, said flexible closure element having a central panel, a lever portion an a connecting portion connecting said central panel with said lever portion, said lever portion being initially positioned in a first position, when said central panel is generally horizontally disposed, as a generally upwardly directed frustoconical skirt portion and having, as viewed in vertical cross-section, a nose at its connection with said connection portion, said metallic end wall and said closure element being constructed and arranged such that, upon positioning said closure element over said openable panel of said metallic end wall and moving said lever portion to a second position including, when said central panel is generally horizontally disposed moving said lever portion to a generally downwardly directed position, said nose portion will sealingly engage at least a continuous annular part of said exterior surface portion of said flange means, said central panel including a substantially flat outer surface and a substantially flat inner surface with said inner and outer surfaces extending substantially parallel to one another, said inner and outer surfaces of said central panel being connected by a frustoconical wall extending substantially entirely around said central panel with said frustoconical wall sloping inwardly towards said inner surface of said central panel away from said connecting portion of said closure element, said outer surface of said central panel including channel means and extension means, said channel means matingly engageable with said beaded flange means for directing said extension means against said openable panel, with said extension means separating at least a portion of said openable panel from said end wall about said scored portion when said extension means engages said openable panel.

5. The invention as claimed in claim 4, wherein said frustoconical wall has at spaced apart intervals abutment means for engaging an inner surface of said flange means.

6. The invention as claimed in claim 1, 2, 3 or 4 wherein said scored portion includes a circular scored portion in said end wall.

7. The invention as claimed in claim 6, wherein said openable panel further includes a hinge comprising an unscored portion in said end wall.

8. The invention as claimed in claims 1, 2, or 3, wherein said central panel includes a substantially flat outer surface, said outer surface having a periphery and including:

said channel means, and an elongated annular guide member means located radially inward from the periphery of said outer surface, said channel means located radially inward and adjacent said guide member means, said guide member means for guiding said mateable engagement between said channel means and said flange means.

9. The invention as claimed in claim 8, wherein said outer surface of the central panel further includes said extension means located radially inward and adjacent said channel means, said extension means engageable with said openable panel to separate said portion of said openable panel when said channel means matably engages with said flange means.

10. The invention as claimed in claim 9 wherein the extension means includes an inclined portion having an apex adjacent said channel means and a sloped portion sloping radially downward.

11. The invention as claimed in claim 9, wherein the extension means includes button means located radially inward from said channel means, said button means for separating said portion of said openable panel from said end wall when said channel means matingly engages said flange means.

12. The invention as claimed in claim 4, wherein said outer surface has a periphery and includes:

said channel means, and an elongated annular guide member means located radially inward from the periphery of said outer surface, said channel means located radially inward and adjacent said guide member means, said guide member means for guiding said mateable engagement between said channel means and said flange means.

13. The invention as claimed in claim 12, wherein said outer surface of said central panel further includes said extension means located radially inward and adjacent said channel means, said extension means engageable with said openable panel to separate said portion of said openable panel when said channel means matably engages with said flange means.

14. The invention as claimed in claim 13 wherein the extension means includes an inclined portion having an apex adjacent said channel means and a sloped portion sloping radially downward.

15. The invention as claimed in claim 13, wherein the extension means includes button means located radially inward from said channel means, said button means for separating said portion of said openable panel from said end wall when said channel means matingly engages said flange means.

16. The invention as claimed in claim 1, 2, 3 or 4 wherein said flange means of said metallic end wall includes a bent over end section with the end section extending in the direction of said openable panel.

17. The invention as claimed in claims 1, 2, 3 or 4 wherein said lever portion has an outer periphery and at least one pull tab is connected to said outer periphery of said lever portion.

18. The invention as claimed in claim 17 wherein said pull tab has means for indicating tampering therewith.

19. The invention as claimed in claim 2, wherein said selected angle is approximately 60°.

20. The invention as claimed in claim 3 wherein said selected angle is approximately 70°.

21. The closure device of claim 1, 2, 3 or 4 wherein said metallic end is formed from an aluminum alloy.

22. The closure device of claim 1, 2, 3 or 4, wherein said flexible closure element is formed from polypropylene.

23. The closure device of claim 1, 2, 3 or 4, wherein said flexible closure element is formed from polyethylene.

24. The closure device of claim 1, 2, 3 or 4 wherein contacting surfaces of said metallic end includes a coating thereon.

25. The closure device of claim 24 wherein said coating comprises a wax or lacquer.

26. The closure device of claim 1, 2, 3 or 4 wherein said closure element is coated with a low ga transmission rate coating material.

27. The closure device of claim 26 wherein said coating material comprises polyvinylidene chloride.

28. The closure device of claim 26 wherein said coating material comprises ethylene vinyl alcohol.

29. The closure device of claim 1, 2, 3 or wherein said end wall includes means for attachment comprising a curl.

30. The closure device of claim 1, 2, 3 or wherein said end wall has means for attachment comprising a surface which may be adhesively bonded to a can.

31. The closure device of claim 1, 2, 3 or wherein said flange means is inwardly beaded.

32. The closure device of claim 1, 2, 3 or wherein said lever portion is of increasing thickness from said connecting portion to its outer periphery.

33. The closure device of claim 1, 2, 3 or wherein said lever portion included a thickened ring portion on its outer periphery.

34. The closure device of claim 1, 2, 3 or wherein said metallic end wall is heated prior to assembly of said closure device.

35. The closure device of claim 1, 2, 3 or wherein said closure element is heated prior to installation on said end wall.

36. The invention of claim 35 wherein said closure element is heated to a temperature between about 95° and 120° F.

37. A closure device for a can comprising a metallic end wall having an openable panel defined by a scored portion of said end wall, and a flexible closure element, said openable panel being substantially surrounded by a beaded flange means that flares outwardly relative to said openable panel, said beaded flange means including an exterior surface portion, said end wall including a wall portion surrounding said flange means with said wall portion extending at a selected angle relative to said exterior surface portion of said flange means, said flexible closure element having a central panel, a lever portion and a connecting portion connecting said central panel with said lever portion, said lever portion being initially positioned in a first position, when said central panel is generally horizontally disposed, as a generally upwardly directed frustoconical skirt portion and having, as viewed in vertical cross-section, a nose at its connection with said connecting portion, said metallic end wall and said closure element being constructed and arranged such that, upon positioning said closure element over said openable panel of said metallic end wall and moving said lever portion to a second position including, when said central panel is generally horizontally disposed, moving said lever portion to a generally downwardly directed position, said nose portion will sealingly engage at least a continuous annular part of the said exterior surface portion of said flange means, said closure element being out of contact with at least a minor portion of the inner surface of said flange means to an extent that said closure element is in non-plug forming relation with the inner surface of said flange means, said central panel including channel means and extension means, said channel means matingly engageable with said beaded flange means for directing said extension means against said openable panel, with said extension means separating at least a portion of said openable panel from said end wall about said scored portion when said extension means engages said openable panel, said beaded flange means including a rounded portion and said closure element including a surface that is of substantially complementary configuration in size, shape and curvature to said rounded portion so that said rounded portion and said surface on said closure element are in substantially full and complete contact with each other upon initial positioning of said closure element over said openable panel prior to inverting said lever portion to a generally downwardly directed position.

38. A closure device for a can comprising a metallic end wall having an openable panel defined by a scored portion in said end wall, and a flexible closure element, said openable panel being substantially surrounded by a beaded flange means that flares outwardly relative to said openable panel, said beaded flange means including an exterior surface portion, said end wall including a wall portion surrounding said flange means with said wall portion extending at a selected angle relative to said exterior surface portion of said flange means, said flexible closure element having a central panel, a lever portion and a connecting portion connecting said central panel with said lever portion, said lever portion being initially positioned in a first position, when said central panel is generally horizontally disposed, as a generally upwardly directed frustoconical skirt portion and having, as viewed in vertical cross-section, a nose at its connection with said connecting portion, said metallic end wall and said closure element being constructed and arranged such that, upon positioning said closure element over said openable panel of said metallic end wall and moving said lever portion to a second position including, when said central panel is generally horizontally disposed, moving said lever portion to a generally downwardly directed position, said nose portion will sealingly engage at least a continuous annular part of the said exterior surface portion of said flange means, said closure element being out of contact with a major portion of the inner surface of said flange means, said metallic end wall having a substantially frustoconical annular section extending outwardly from said flange means and said lever portion having a smooth surfaced section which intimately engages said substantially frustoconical annular section of said end wall when moved to said second position so as to substantially prevent ingress of dirt and the like between said lever portion in said second position and said annular section of said end wall, said openable panel of said end wall having a neck portion of minimum diameter relative to other portions of said openable panel, said exterior surface portion of said flange means extending at a selected angle of between about 30° and about 40° to a plane passing through said neck portion, said central panel including a substantially flat outer surface and a substantially flat inner surface with said inner and outer surfaces extending substantially parallel to one another, said inner and outer surfaces of said central panel being connected by a frustoconical wall extending substantially entirely around said central panel with said frustoconical wall sloping inwardly toward said inner surface of said central panel away from said connecting portion of said closure element, said outer surface of said central panel including channel means and extension means, said channel means matingly engageable with said beaded flange means for directing said extension means against said openable panel, with said extension means separating at least a portion of said openable panel from said end wall about said scored portion when said extension means engages said openable panel.

39. A closured device for a can, said closure device comprising a metallic end and a flexible closure element, said metallic end having an openable panel defined by a scored portion in said end wall, the openable panel being bounded by an outwardly and upwardly flaring beaded flange and having means adjacent its periphery for attachment to said can, said metallic end including an upwardly and inwardly tapering section between said means and said flange, said flexible closure element having a central panel, a lever portion and a connecting portion connecting said central panel and said lever portion, said lever portion being initially positioned as a generally upwardly directed frustoconical portion or skirt and having, as viewed in vertical cross-section, a nose at its connection with said connecting portion, said metallic end and said connecting element being constructed and arranged such that upon positioning said closure element over said openable panel in said metallic end and inverting said lever portion to a generally downwardly directed position, said nose portion sealingly contacts the outer surface of said flange without mechanically hooking under the outer surface of said flange and said connecting portion sealingly contacts said flange in a tangential relationship defined between said central panel and said flange while said lever portion abuts against said tapering section of said metallic end, said closure element being out of contact with the inner surface of said flange, said central panel including channel means and extension means, said channel means matingly engageable with said beaded flange means for directing said extension means against said openable panel, with said extension means separating at least a portion of said openable panel from said end wall about said scored portion when said extension means engages said openable panel.

40. The closure device of claim 39 wherein the upper end of said beaded flange includes a rounded portion and said closure element includes a surface that is of substantially complementary configuration in size, shape and curvature to said rounded portion so that said rounded portion and said surface on said closure element are in substantially full and complete contact with each other upon the initial positioning of said closure element over said openable panel prior to inverting said lever portion to a generally downwardly directed position.

41. The closure device of claim 40 wherein, when viewed in vertical cross-section, the surface of said beaded flange immediately below said rounded portion is a straight line, and the surface complementary portion thereof is also a straight line, whereby said inverting brings the two straight line surfaces into contact with each other without any substantial sliding therebetween.

42. The invention as claimed in claim 37, 38, or 39 wherein said scored portion includes a circular scored portion in said end wall.

43. The invention as claimed in claim 42, wherein said openable panel further includes a hinge comprising an unscored portion in said end wall.

44. The invention as claimed in claims 37 or 39, wherein said central panel includes a substantially flat outer surface, said outer surface having a periphery and including:

said channel means, and an elongated annular guide member means located radially inward from the periphery of said outer surface, said channel means located radially inward and adjacent said guide member means, said guide member means for guiding said mateable engagement between said channel means and said flange means.

45. The invention as claimed in claim 44, wherein said outer surface of he central panel further includes said extension means located radially inward and adjacent said channel means, said extension means engageable with said operable panel to separate said portion of said openable panel when said channel mean matably engages with said flange means.

46. The invention as claimed in claim 45 wherein the extension means includes an inclined portion having an apex adjacent said channel means and a sloped portion sloping radially downward.

47. The invention as claimed in claim 45, wherein the extension means includes button means located radially inward from said channel means, said button means for separating said portion of said openable panel from said end wall when said channel means matingly engages said flange means.

48. The invention as claimed in claim 38, wherein said outer surface has a periphery and includes:

said channel means, and an elongated annular guide member means located radially inward from the periphery of said outer surface, said channel means located radially inward and adjacent said guide member means, said guide member means for guiding said mateable engagement between said channel means and said flange means.

49. The invention as claimed in claim 48, wherein said outer surface of said central panel further includes said extension means located radially inward and adjacent said channel means, said extension means engageable with said openable panel to separate said portion of said openable panel when said channel means matably engages with said flange means.

50. The invention as claimed in claim 49 wherein the extension means includes an inclined portion having an apex adjacent said channel means and a sloped portion sloping radially downward.

51. The invention as claimed in claim 49, wherein the extension means includes button means located radially inward from said channel means, said button means for separating said portion of said openable panel from said end wall when said channel means matingly engages said flange means.

52. The closure device of claim 51 wherein said metallic end is formed from a steel or aluminum alloy.

53. The closure device of claim 39 wherein said flexible closure element is formed from polyethylene or polypropylene.

54. The closure device of claim 39 wherein contacting surfaces of said metallic end and/or said flexible closure element includes a coating thereon.

55. The closure device of claim 54 wherein said coating comprises a wax of lacquer.

56. The closure device of claim 39 wherein said flexible closure element is coated with a low gas transmission rate coating material.

57. The closure device of claim 39 wherein said coating material comprises polyvinylidene chloride or ethylene vinyl alcohol.

58. The closure device of claim 39 wherein said means for attachment comprises a curl.

59. The closure device of claim 39 wherein said means for attachment comprises a surface which may be adhesively bonded to said can.

60. The closure device of claim 39 wherein said flange is outwardly beaded.

61. The closure device of claim 39 wherein said flange is inwardly beaded.

62. The closure device of claim 39 wherein said lever portion is of increasing thickness from said connecting portion to its outer periphery.

63. The closure device of claim 39 wherein said lever portion includes a thickened ring portion on its outer periphery.

64. The closure device of claim 39 wherein said lever portion includes at leas one tab at its outer periphery.

65. The closure device of claim 39 wherein said central panel is of decreasing thickness towards its outer periphery.

66. The closure device of claim 39 wherein said metallic end and/or said flexible closure element is heated prior to assembly of said closure device.

67. The closure of claim 66 wherein said metallic end and/or said flexible closure element is heated to a temperature between about 95° and 150° F. (35° and 65.6° C.).

68. The closure device of claim 1, 2, 3, 4, 37, 38 or 39 wherein said openable panel and said closure element include centering means to position said closure element on said openable panel for opening.

69. The closure device of claim 68 wherein said centering means comprises a dimple on said openable panel and a recess in said central panel of said closure element.

70. The closure device of claim 1, 2, 3, 4, 37, 38 or 39 wherein said openable panel includes a pressure point to concentrate opening force on an area of said openable panel.

* * * * *